US006297784B1

(12) United States Patent
Chang

(10) Patent No.: US 6,297,784 B1
(45) Date of Patent: Oct. 2, 2001

(54) BI-FREQUENCY CELLULAR TELEPHONE ANTENNA

(75) Inventor: Daniel Chang, Pa-Te (TW)

(73) Assignee: Auden Techno Corp., Taoyuan Hsien (TW)

( * ) Notice: Subject to any disclaimer, the term of this patent is extended or adjusted under 35 U.S.C. 154(b) by 0 days.

(21) Appl. No.: 09/184,260

(22) Filed: Nov. 2, 1998

(51) Int. Cl.[7] ..... H01Q 1/36
(52) U.S. Cl. ..... 343/895; 343/702; 343/700 MS
(58) Field of Search ..... 343/895, 702, 343/700 MS, 750, 820, 821–823

(56) References Cited

U.S. PATENT DOCUMENTS 4,375,642 * 3/1983 Dorrie et al. ..... 343/895
4,376,939 * 3/1983 Reid ..... 343/715
4,772,895 * 9/1988 Garay et al. ..... 343/895
5,168,278 * 12/1992 Morita ..... 343/702
5,436,633 * 7/1995 Liu ..... 343/723
5,469,177 * 11/1995 Rush et al. ..... 343/702
5,493,311 * 2/1996 Itoh et al. ..... 343/860
5,754,146 * 5/1998 Knowles et al. ..... 343/895
5,990,848 * 11/1999 Annamaa et al. ..... 343/985
6,016,130 * 1/2000 Annamaa ..... 343/895
6,097,340 * 8/2000 Chang ..... 343/702
6,163,300 * 12/2000 Ishikawa et al. ..... 343/702

* cited by examiner

*Primary Examiner*—Don Wong
*Assistant Examiner*—Tuyet T. Vo
(74) *Attorney, Agent, or Firm*—Dougherty & Troxell

(57) ABSTRACT

A bi-frequency cellular telephone antenna includes a shaft fastened to a cellular telephone, an insulative barrel fastened to the shaft at a top side, a first coil for a first frequency mounted inside the insulative barrel, and a second coil for a second frequency mounted around the periphery of the insulative barrel.

3 Claims, 4 Drawing Sheets

BI-FREQUENCY CELLULAR TELEPHONE ANTENNA

BACKGROUND OF THE INVENTION

The present invention relates to a cellular telephone antenna, and more particularly to a bi-frequency cellular telephone antenna which uses two coils to form a bi-frequency antenna structure.

Conventional cellular telephones are specifically designed for a particular frequency. There are disclosed a variety of advanced cellular telephones with bi-frequency antenna capable of matching GSM900 and GSM1800. FIGS. 1 and 2 show a bi-frequency antenna for a cellular telephone according to the prior art. This structure of bi-frequency antenna uses a conductive plate 10 instead of a winding. The conductive plate 10 is made of a thin sheet of metal by stamping, having a wave-like vertical section 11, and a wave-like horizontal section 12. When the conductive plate 10 is made, it is adhered to the periphery of a shaft 13. Because the stamping die for making the conductive plate 10 is of high precision, the cost is high. Further, adhering the conductive plate 10 to the periphery of the shaft 13 is not an easy job.

SUMMARY OF THE INVENTION

It is the main object of the present invention to provide a bi-frequency cellular telephone antenna which is simple and inexpensive. According to the present invention, the bi-frequency cellular telephone antenna comprises a shaft fastened to a cellular telephone, an insulative barrel fastened to the shaft at a top side, a first coil for a first frequency mounted inside the insulative barrel, and a second coil for a second frequency mounted around the periphery of the insulative barrel.

DETAILED DESCRIPTION OF THE PREFERRED EMBODIMENT

Figure 1:
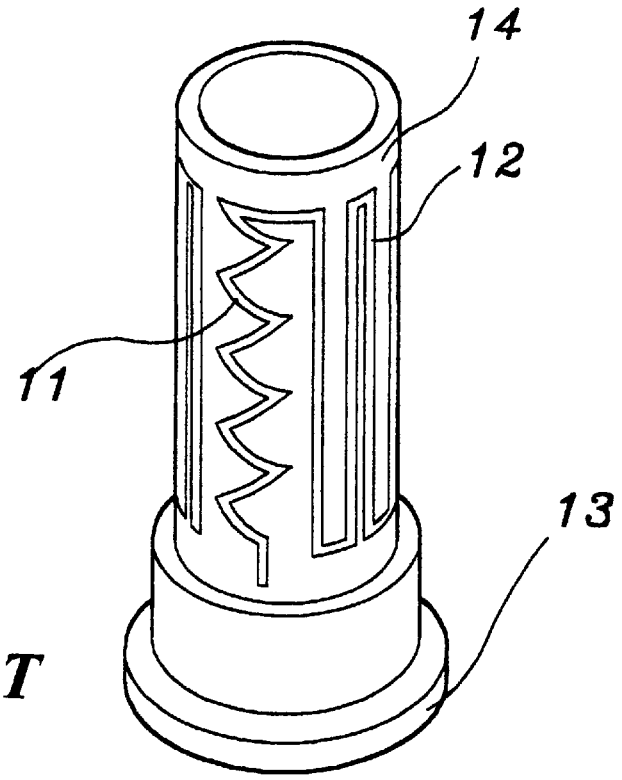
FIG. 1 PRIOR ART
FIG. 1 is a perspective view of a bi-frequency cellular telephone antenna according to the prior art.
Figure 2:
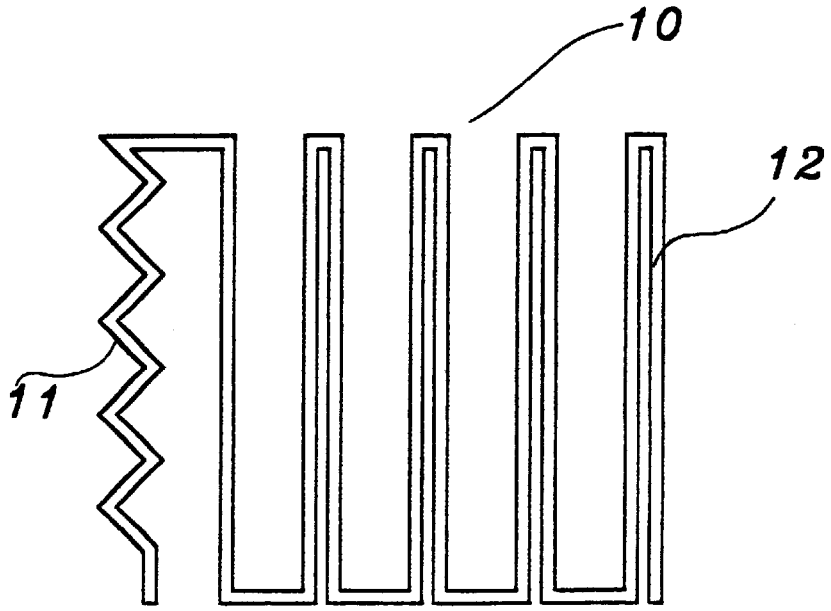
FIG. 2 PRIOR ART
FIG. 2 is an extended out view of the conductive plate shown in FIG. 1.
Figure 3:
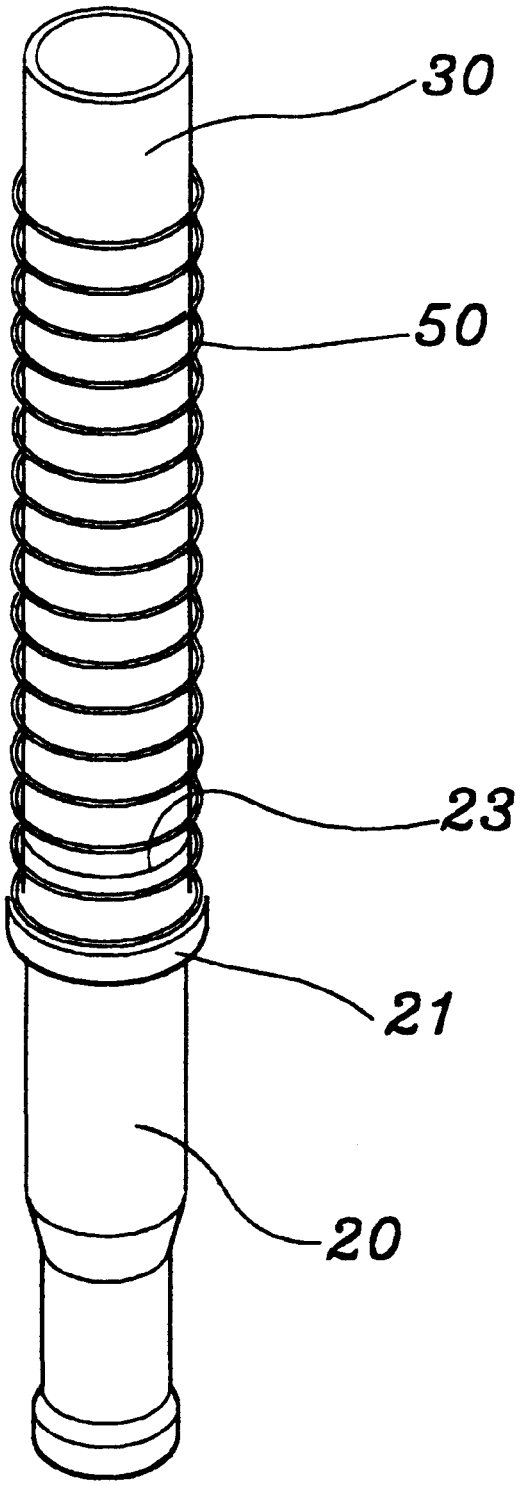
FIG. 3 is a perspective view of a bi-frequency cellular telephone antenna according to the present invention.
Figure 4:
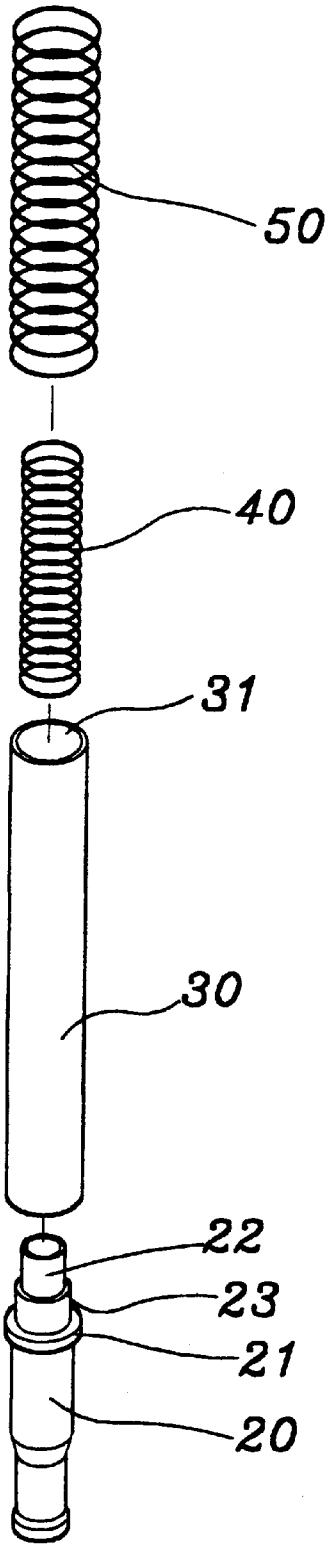
FIG. 4 is an exploded view of the bi-frequency cellular telephone antenna shown in FIG. 3.

Referring to FIGS. from 3 through 5, a bi-frequency cellular telephone antenna in accordance with the present invention is generally comprised of a shaft 20 for connection to a cellular telephone, an insulative barrel 30 connected to the shaft 20 at the top, a first coil 40 mounted within the insulative barrel 30, and a second coil 50 mounted around the periphery of the insulative barrel 30.

Figure 5:
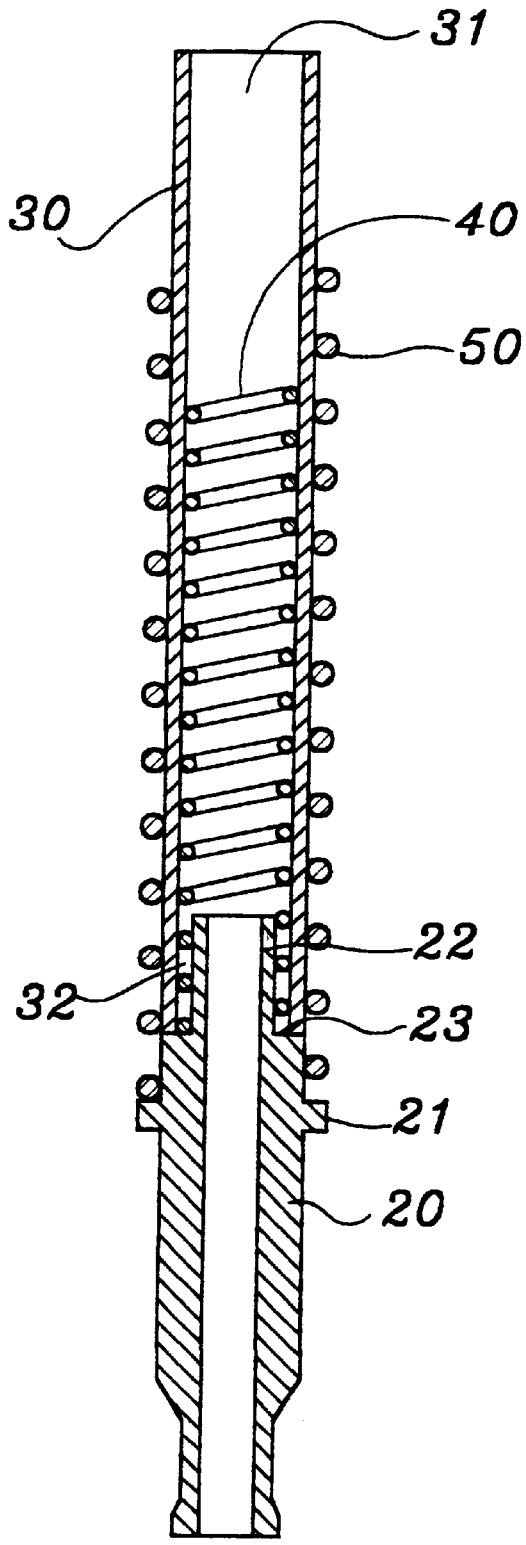
FIG. 5 is a sectional view in an enlarged scale of the bi-frequency cellular telephone antenna shown in FIG. 3.

The shaft 20 comprises a stepped upper section formed of an upper small diameter portion 22 and a lower big diameter portion 23, and an outward flange 21 raised around the periphery of the lowest end of the lower big diameter portion 23. The insulative barrel 30 is mounted on the lower big diameter portion 23 of the shaft 20 around the upper small diameter portion 22. After installation of the insulative barrel 30, an annular space 32 is defined within the insulative barrel 30 around the upper small diameter portion 22 of the shaft 20 (see FIG. 5). The first coil 40 is made of a metal wire, and mounted on the upper small diameter portion 22 of the shaft 20 within the insulative barrel 30. The second coil 50 is made of a metal wire, and mounted on the outward flange 21 of the shaft 20 around the periphery of the insulative barrel 30.

The aforesaid first coil 40 and second coil 50 are obtained subject to the following equation:

assume match frequency is $f_0$, thus, $$f_0 = \frac{1}{2\pi\sqrt{LC}}$$

in which L=inductance value, C=capacitance value because $$Z_L = jwL\left(j = \sqrt{-1},\ w = 2\pi f\right)\ Z_c = \frac{1}{jwL}$$

When matching both $Z_L+Z_C=0$, thus, $$jwL + \frac{1}{jwL} = 0$$

$$-w^2L + \frac{1}{C} = 0$$

$$w^2 = \frac{1}{LC}$$

$$w^2 = \frac{1}{LC}$$

$$w = \frac{1}{\sqrt{LC}}$$

$$\therefore f_0 = \frac{1}{2\pi\sqrt{LC}}$$

When the test values of the coils to be used are put in the aforesaid equation, the desired coils for bi-frequency cellular telephone antenna are obtained.

Because the coils for the bi-frequency cellular telephone are of common components that can easily be obtained, the manufacturing cost of the bi-frequency cellular telephone antenna is low.

What is claimed is:

1. A bi-frequency cellular telephone antenna comprising:

a) a shaft configured to be fastened to a cellular telephone, the shaft having a stepped upper section formed by an upper smaller diameter portion and a lower, larger diameter portion, and an outward flange located below the stepped upper section;

b) a hollow, tubular insulative barrel fixedly mounted on the lower, larger diameter portion and extending therefrom so as to surround and be spaced from the upper, smaller diameter portion;

c) a first coil of metal wire for a first frequency mounted on the upper smaller diameter portion and located completely within the hollow insulative barrel; and, d) a second coil of metal wire for a second frequency mounted on the outward flange and extending around a periphery of the insulative barrel.

2. The bi-frequency cellular telephone antenna of claim 1 wherein the first and second coils have a match frequency $f_0$ selected according to the formula:

$$f_0 = \frac{1}{2\pi\sqrt{LC}}$$

where:

L=inductance value

C=capacitance value

3. The bi-frequency cellular telephone antenna of claim 1 wherein said first coil has a bottom end inserted into an annular space between said upper smaller diameter portion and said insulative barrel, and is supported on said lower larger portion.

* * * * *